US006748624B1

(12) United States Patent
Aderholt

(10) Patent No.: US 6,748,624 B1
(45) Date of Patent: Jun. 15, 2004

(54) HOOD SUPPORT PISTON STOPPER

(76) Inventor: H. Steve Aderholt, 9834 Teasdale Tr., Austin, TX (US) 78753

( * ) Notice: Subject to any disclaimer, the term of this patent is extended or adjusted under 35 U.S.C. 154(b) by 17 days.

(21) Appl. No.: 10/317,671

(22) Filed: Dec. 12, 2002

Related U.S. Application Data

(60) Provisional application No. 60/347,984, filed on Jan. 10, 2002.

(51) Int. Cl.[7] ..... E05F 5/02

(52) U.S. Cl. ..... 16/82; 16/66; 16/71

(58) Field of Search ..... 16/82, 83, 51, 16/66, 71, 352; 180/69.2, 69.21, 274, 281; 296/56, 76; 267/64.12, 64.15, 64.26, 120; 188/300, 321.11

(56) References Cited

U.S. PATENT DOCUMENTS

| | | | | | |
|---|---|---|---|---|---|
| 3,708,825 | A | * | 1/1973 | Wood | 16/49 |
| 3,883,126 | A | * | 5/1975 | Nicholls | 267/64.12 |
| 4,449,702 | A | * | 5/1984 | Hasegawa | 267/64.12 |
| 4,596,386 | A | * | 6/1986 | Sackl | 482/61 |
| 4,711,548 | A | * | 12/1987 | Arakawa et al. | 396/542 |
| 4,777,698 | A | * | 10/1988 | Lord | 16/66 |
| 4,813,100 | A | * | 3/1989 | King | 16/49 |
| 4,824,082 | A | * | 4/1989 | Schaupp | 267/120 |
| 5,358,225 | A | * | 10/1994 | Volpel et al. | 267/64.12 |
| 5,575,513 | A | * | 11/1996 | Tuttle | 292/339 |
| 6,273,405 | B2 | * | 8/2001 | Okamoto | 267/64.12 |
| 6,601,834 | B2 | * | 8/2003 | Perry | 267/64.12 |

FOREIGN PATENT DOCUMENTS

| | | | | | |
|---|---|---|---|---|---|
| JP | 01229775 | A | * | 9/1989 | B62D/25/10 |
| JP | 11082589 | A | * | 3/1999 | F16F/9/00 |

* cited by examiner

*Primary Examiner*—Chuck Y. Mah

(57) ABSTRACT

A hood support piston stopper that is positionable in connection with the hood support piston assembly of a vehicle in a manner to prevent the piston rod of the hood support piston assembly from sliding back into the cylinder allowing the hood to move from the raised to the closed position. To maintain the stopper in a handy location under the vehicle hood of a vehicle with a faulty hood support piston assembly it would be a further benefit to have a tether for securing the stopper in an out of the way but readily accessible location under the vehicle hood.

1 Claim, 3 Drawing Sheets

HOOD SUPPORT PISTON STOPPER

This application claims the benefist of Provisional application Ser. No. 60/347,984, filed Jan. 10, 2002.

TECHNICAL FIELD

The present invention relates to vehicle tools and safety devices and more particularly to a hood support piston stopper that maintains the hood support piston assembly extended in a manner to prevent the hood of the vehicle from falling onto a worker while the worker is positioned between the engine and the lifted hood of a vehicle; the hood support piston stopper including an elongated stopper member having a substantially C-shaped cross section along the length thereof; a lateral insertion slot along the entire length thereof for allowing the rod portion of a hood support piston to be inserted into a piston rod receiving channel defined by the elongated stopper member; a storage tether attached to an end of the elongated stopper member for allowing convenient storage of the hood support piston stopper within the engine compartment when it is not in use; a cylinder insertion slot being provided at one end of the elongated stopper member wherein the cylinder insertion slot is greater in width than the lateral insertion slot to allow a bottom end of the cylinder to rest on a ledge top formed at the connection point of the lateral insertion slot and the cylinder insertion slot; the elongated stopper member being positioned over an extended piston rod of a hood support piston to prevent the piston rod from sliding back into the cylinder while a person is positioned between the lifted vehicle hood and the engine.

BACKGROUND ART

Many times the hood support piston assembly of a vehicle will become damaged to the point where it does not reliably support the hood of the vehicle in the raised position. When a person is positioned between the raised hood and the engine of the vehicle, severe injuries can occur should the hood support piston assembly suddenly allow the hood to drop. It would of course be a benefit to anyone having such a problem with the hood support piston assembly of their vehicle or anybody who works on car engines or the like to have a stopper structure that could be positioned in connection with the hood support piston assembly in a manner to prevent the piston rod of the hood support piston assembly from sliding back into the cylinder. To maintain the stopper in a handy location under the vehicle hood of a vehicle with a faulty hood support piston assembly it would be a further benefit to have a tether for securing the stopper in an out of the way but readily accessible location under the vehicle hood.

GENERAL SUMMARY DISCUSSION OF INVENTION

It is thus an object of the invention to provide a hood support piston stopper that includes an elongated stopper member having a substantially C-shaped cross section along the length thereof; a lateral insertion slot along the entire length thereof for allowing the rod portion of a hood support piston to be inserted into a piston rod receiving channel defined by the elongated stopper member; a storage tether attached to an end of the elongated stopper member for allowing convenient storage of the hood support piston stopper within the engine compartment when it is not in use; a cylinder insertion slot being provided at one end of the elongated stopper member wherein the cylinder insertion slot is greater in width than the lateral insertion slot to allow a bottom end of the cylinder to rest on a ledge top formed at the connection point of the lateral insertion slot and the cylinder insertion slot; the elongated stopper member being positioned over an extended piston rod of a hood support piston to prevent the piston rod from sliding back into the cylinder while a person is positioned between the lifted vehicle hood and the engine.

Accordingly, a hood support piston stopper is provided. The hood support piston stopper includes an elongated stopper member having a substantially C-shaped cross section along the length thereof; a lateral insertion slot along the entire length thereof for allowing the rod portion of a hood support piston to be inserted into a piston rod receiving channel defined by the elongated stopper member; a storage tether attached to an end of the elongated stopper member for allowing convenient storage of the hood support piston stopper within the engine compartment when it is not in use; a cylinder insertion slot being provided at one end of the elongated stopper member wherein the cylinder insertion slot is greater in width than the lateral insertion slot to allow a bottom end of the cylinder to rest on a ledge top formed at the connection point of the lateral insertion slot and the cylinder insertion slot; the elongated stopper member being positioned over an extended piston rod of a hood support piston to prevent the piston rod from sliding back into the cylinder while a person is positioned between the lifted vehicle hood and the engine.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
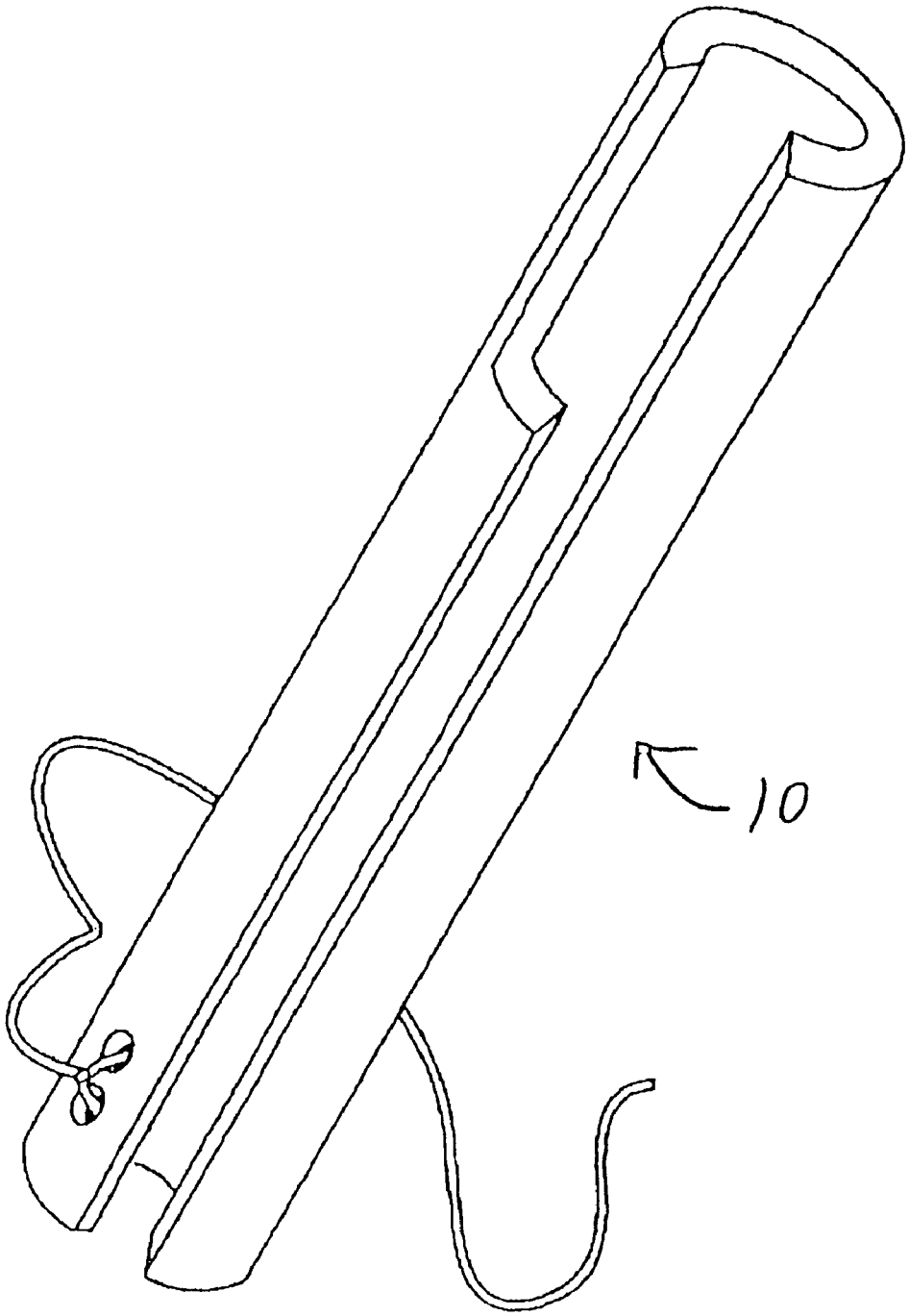
FIG. 1 is a perspective view of an exemplary embodiment of the hood support piston stopper of the present invention.
Figure 2:
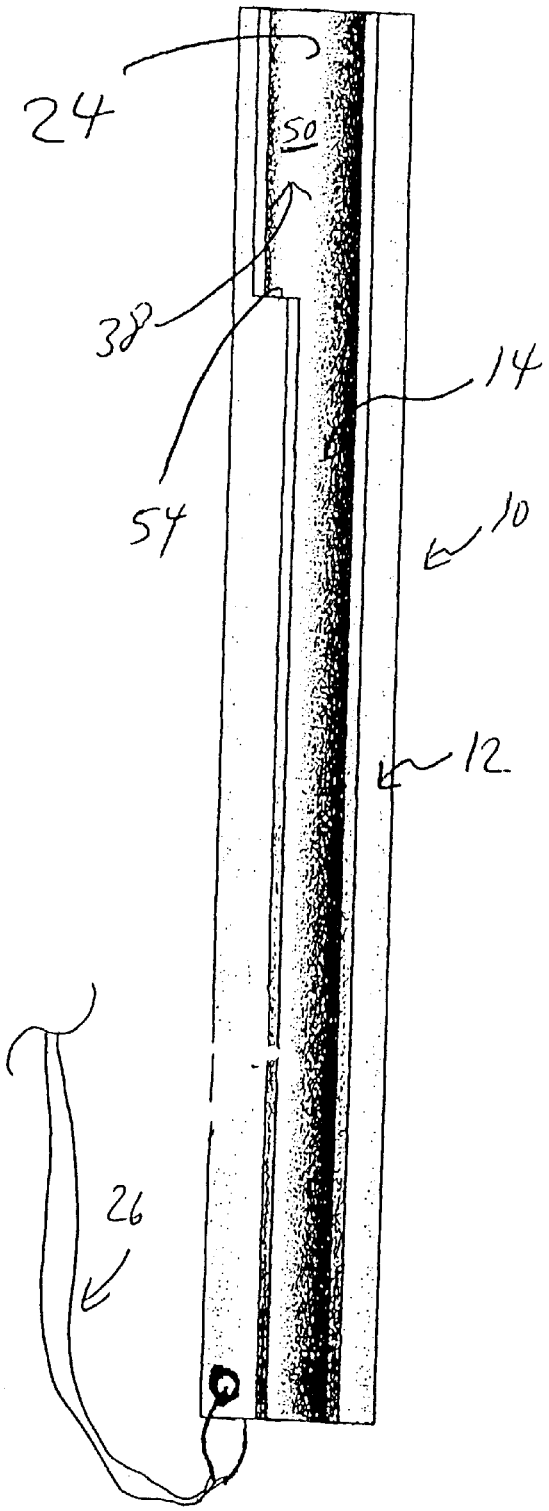
FIG. 2 is a front plan side view of the hood support piston stopper of FIG. 1.
Figure 3:
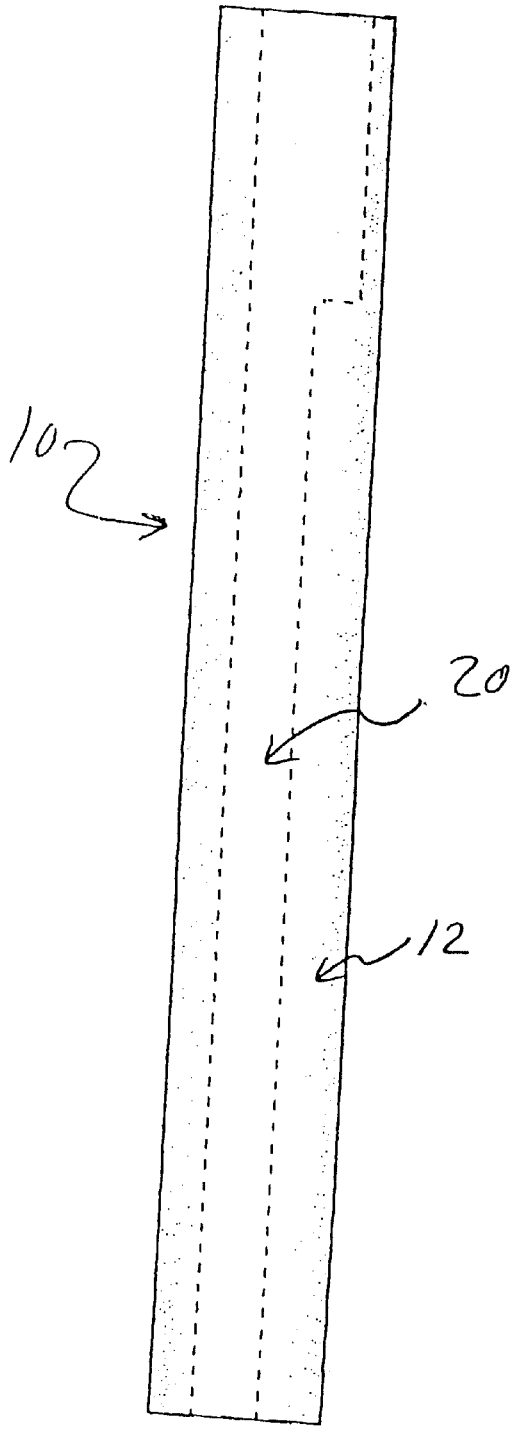
FIG. 3 is a rear plan side view of the hood support piston stopper of FIG. 1.
Figure 6:
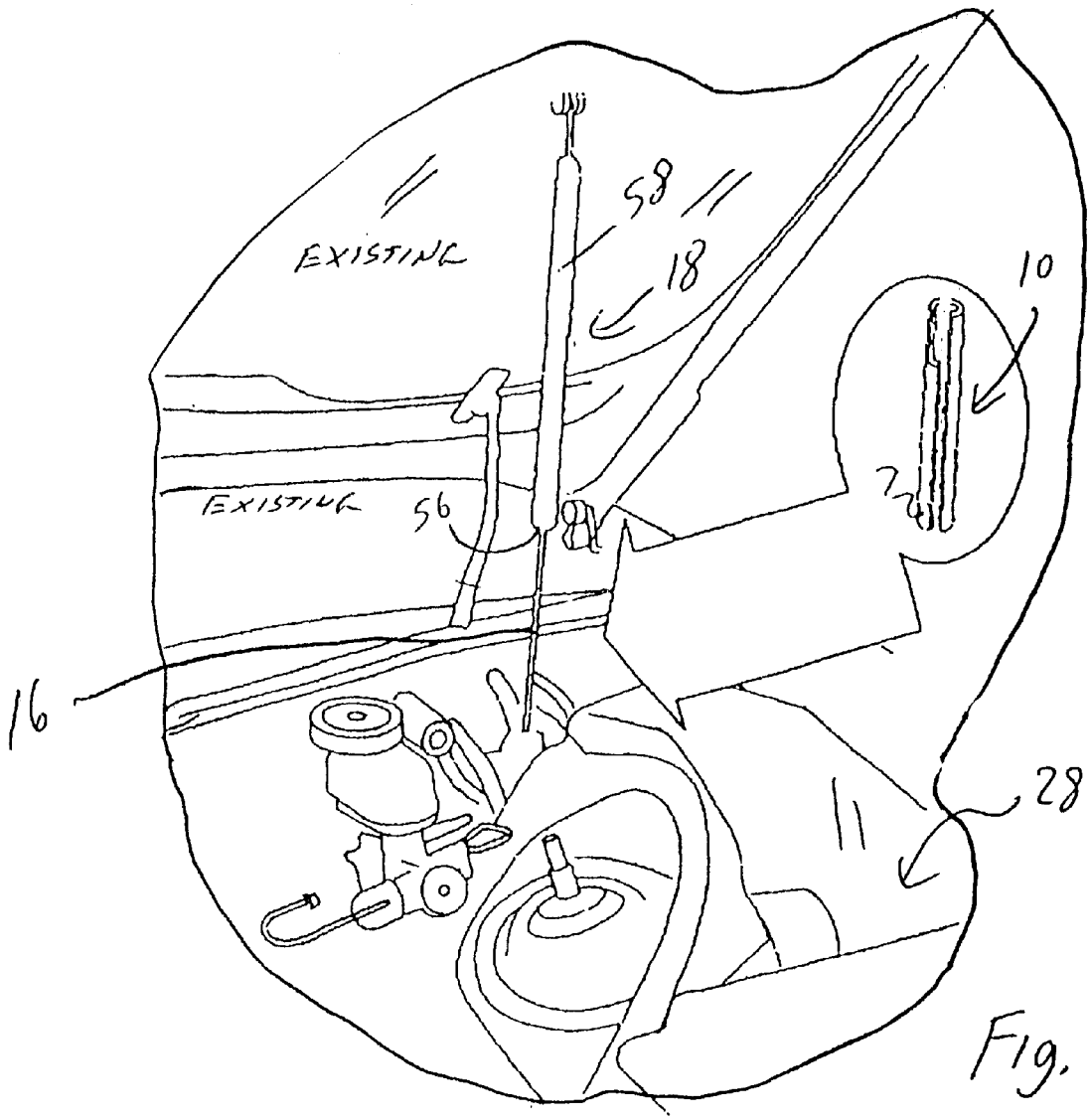
FIG. 6 is a perspective view showing a representative vehicle hood in the raised position, a representative hood support piston assembly including the piston rod and cylinder, a vehicle engine, and the hood support piston stopper of FIG. 1.
Figure 4:
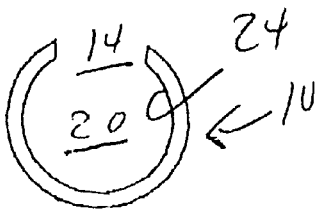
FIG. 4 is a bottom plan view of the hood support piston stopper of FIG. 1.
Figure 5:
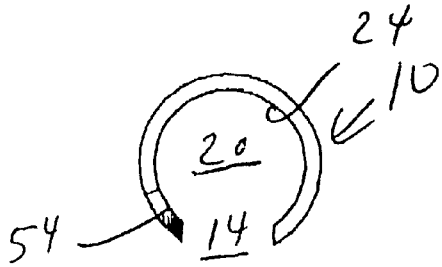
FIG. 5 is a top plan view of the hood support piston stopper of FIG. 1.

FIGS. 1–6 show various aspects of an exemplary embodiment of the hood support piston stopper of the present invention generally designated 10. Hood support piston stopper 10 includes an elongated, high temperature resistant plastic, stopper member, generally designated 12, having a substantially C-shaped cross section along the length thereof. A lateral insertion slot 14 is provided along the entire length of the stopper member 12 to allow the rod portion 16 of a hood support piston assembly, generally designated 18, to be inserted into a piston rod receiving channel 20 defined by the inner wall 24 of elongated stopper member 12.

A storage tether, generally designated 26, is attached to an end of the elongated stopper member 12 for allowing a user to attach hood support piston stopper 10 in a convenient storage location within the engine compartment, generally designated 28, when hood support piston stopper 10 is not in use.

Elongated stopper member 12 further includes a cylinder insertion slot, generally designated 38, provided at one end of thereof that is partially formed by lateral insertion slot 14 plus an additional void area 50 adjacent lateral insertion slot 14. An edge of elongated stopped member adjacent void area 50 forms a ledge 54 to support a bottom end 56 of a cylinder 58 of hood support piston assembly 18 when the bottom end 56 is at least partially inserted into cylinder insertion slot 38 and rod portion 16 is positioned within piston rod receiving channel 20.

It can be seen from the preceding description that a hood support piston stopper has been!provided.

It is noted that the embodiment of the hood support piston topper described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hood support piston stopper comprising:

an elongated stopper member having a substantially C-shaped cross section along the length thereof;

a lateral insertion slot along the entire length thereof for allowing a rod portion of a hood support piston to be inserted into a piston rod receiving channel defined by the elongated stopper member;

a storage tether attached to an end of the elongated stopper member for allowing convenient storage of the hood support piston stopper within the engine compartment when it is not in use;

a cylinder insertion slot being provided at one end of the elongated stopper member wherein the cylinder insertion slot is greater in width than the lateral insertion slot to allow a bottom end of a cylinder of the hood support piston to rest on a ledge top formed at the connection point of the lateral insertion slot and the cylinder insertion slot;

the elongated stopper member being positioned over an extended piston rod of a hood support piston to prevent the piston rod from sliding back into the cylinder while a person is positioned between the lifted vehicle hood and the engine.

* * * * *